US010923039B2

(12) United States Patent
Yu et al.

(10) Patent No.: US 10,923,039 B2
(45) Date of Patent: Feb. 16, 2021

(54) OLED PIXEL CIRCUIT AND DRIVING METHOD THEREOF, AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventors: Yong Yu, Beijing (CN); Chuanyan Lan, Beijing (CN); Jing Liu, Beijing (CN); Kwang Gyun Jang, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 333 days.

(21) Appl. No.: 15/781,445

(22) PCT Filed: Oct. 25, 2017

(86) PCT No.: PCT/CN2017/107624
§ 371 (c)(1),
(2) Date: Jun. 4, 2018

(87) PCT Pub. No.: WO2018/157613
PCT Pub. Date: Sep. 7, 2018

(65) Prior Publication Data

US 2020/0273410 A1 Aug. 27, 2020

(30) Foreign Application Priority Data

Mar. 3, 2017 (CN) ..... 201710124211

(51) Int. Cl.
*G09G 3/3291* (2016.01)

(52) U.S. Cl.
CPC ... *G09G 3/3291* (2013.01); *G09G 2300/0809* (2013.01); *G09G 2310/0278* (2013.01)

(58) Field of Classification Search
CPC ..... G09G 3/3291; G09G 2300/0809; G09G 2310/0278; G09G 3/3208
See application file for complete search history.

(56) References Cited

U.S. PATENT DOCUMENTS 6,847,193 B2 * 1/2005 Sakuragi ..... G09G 3/3216 320/166
7,256,774 B1 * 8/2007 Senda ..... G09G 3/3233 315/169.3

(Continued)

FOREIGN PATENT DOCUMENTS

CN 104464616 A 3/2015
CN 104680976 A 6/2015

(Continued)

OTHER PUBLICATIONS

International Search Report and Written Opinion dated Jan. 24, 2018; PCT/CN2017/017624.

*Primary Examiner* — Grant Sitta

(57) ABSTRACT

Provided are an OLED pixel circuit and a driving method thereof, and a display device. The OLED pixel circuit includes: an initialization sub-circuit coupled to a driving sub-circuit, a first signal terminal, a first voltage terminal and an initial voltage terminal, respectively, and configured to initialize the driving sub-circuit; a data writing and compensation sub-circuit coupled to the driving sub-circuit, a scan signal terminal and a data voltage terminal, respectively, and configured to perform threshold voltage compensation for the driving sub-circuit; the driving sub-circuit further coupled to a light-emitting control sub-circuit and the first voltage terminal, and configured to drive a light- (Continued)

emitting sub-circuit to emit light after threshold voltage compensation has been performed.

14 Claims, 7 Drawing Sheets

(56) References Cited

U.S. PATENT DOCUMENTS

| | | | | |
|---|---|---|---|---|
| 8,902,208 | B2 * | 12/2014 | Chung | G09G 3/3233 345/211 |
| 9,041,704 | B2 * | 5/2015 | Lee | G09G 3/3291 345/212 |
| 9,390,653 | B2 * | 7/2016 | Lin | G09G 3/3241 |
| 9,786,730 | B2 * | 10/2017 | Cho | H01L 27/3248 |
| 10,115,345 | B2 * | 10/2018 | Wang | G09G 3/3233 |
| 2004/0041525 | A1 * | 3/2004 | Park | G09G 3/3241 315/169.3 |
| 2006/0132400 | A1 * | 6/2006 | Cok | G09G 3/3208 345/81 |
| 2006/0152454 | A1 * | 7/2006 | Cok | G09G 3/3208 345/82 |
| 2006/0164345 | A1 * | 7/2006 | Sarma | G09G 3/30 345/76 |
| 2009/0146987 | A1 * | 6/2009 | Kim | G09G 3/3233 345/212 |
| 2009/0225013 | A1 * | 9/2009 | Lee | G09G 3/3233 345/80 |
| 2011/0193850 | A1 * | 8/2011 | Chung | H05B 45/10 345/212 |
| 2011/0227885 | A1 * | 9/2011 | Chung | G09G 3/3241 345/204 |
| 2012/0162275 | A1 * | 6/2012 | Park | G09G 3/3283 345/690 |
| 2016/0117983 | A1 | 4/2016 | Li et al. | |
| 2016/0148988 | A1 * | 5/2016 | Cho | G09G 3/3233 257/40 |
| 2016/0358546 | A1 | 12/2016 | Ma | |
| 2017/0069264 | A1 | 3/2017 | Dai et al. | |
| 2017/0270860 | A1 | 9/2017 | Mang et al. | |

FOREIGN PATENT DOCUMENTS

| | | | |
|---|---|---|---|
| CN | 105185304 | A | 12/2015 |
| CN | 105185305 | A | 12/2015 |
| CN | 105789250 | A | 7/2016 |
| CN | 106652903 | A | 5/2017 |
| KR | 20100045578 | A | 5/2010 |

* cited by examiner

OLED PIXEL CIRCUIT AND DRIVING METHOD THEREOF, AND DISPLAY DEVICE

CROSS-REFERENCE TO RELATED APPLICATIONS

The present application claims priority of the Chinese Patent Application No. 201710124211.X filed on Mar. 3, 2017, the entire disclosure of which is hereby incorporated in full text by reference.

TECHNICAL FIELD

Embodiments of the present disclosure relate to an OLED pixel circuit and a driving method thereof, and a display device.

BACKGROUND

OLED (Organic Light Emitting Diode) display is one of the current research hotspots. Compared with LCD (Liquid Crystal Display), OLED has advantages such as low energy consumption, low production cost, self-luminance, wide viewing angle, fast response, etc. Pixel circuit design is the core technical content of OLED display and has important research significance.

A display area of a display panel includes a plurality of OLED pixel circuits. When a first frame of image is displayed, since the circuit of each OLED pixel circuit is unstable, the driving transistor in each OLED pixel circuit is not turned on in a uniform degree, resulting in that the current flowing through the driving transistor to the light-emitting device is not uniform in terms of magnitude either, which may cause problems such as a splash screen during power-on and a wake-up splash screen on the display panel.

SUMMARY

An embodiment of the present disclosure provides an OLED pixel circuit, comprising: an initialization sub-circuit, a data writing and compensation sub-circuit, a light-emitting control sub-circuit, a driving sub-circuit, and a light-emitting sub-circuit; the initialization sub-circuit is coupled to the driving sub-circuit, a first signal terminal, a first voltage terminal and an initial voltage terminal, respectively, and configured to initialize the driving sub-circuit under control of the first signal terminal, the initial voltage terminal and the first voltage terminal; the data writing and compensation sub-circuit is coupled to the driving sub-circuit, a scan signal terminal and a data voltage terminal, respectively, and configured to perform threshold voltage compensation for the driving sub-circuit through a signal inputted at the data voltage terminal under control of the scan signal terminal; the driving sub-circuit is further coupled to the light-emitting control sub-circuit and the first voltage terminal, and configured to drive the light-emitting sub-circuit to emit light under control of the first voltage terminal and the light-emitting control sub-circuit after threshold voltage compensation has been performed; the light-emitting control sub-circuit is further coupled to the light-emitting sub-circuit, an enable signal terminal, a second voltage terminal, a second signal terminal and a third voltage terminal, and configured to enable the light-emitting sub-circuit to be turned on or off under control of the enable signal terminal, the second voltage terminal, the second signal terminal and the third voltage terminal.

In an embodiment, the driving sub-circuit comprises a storage capacitor and a driving transistor; a first terminal of the storage capacitor is coupled to the initialization sub-circuit, the data writing and compensation sub-circuit and the light-emitting control sub-circuit, and a second terminal of the storage capacitor is coupled to a gate of the driving transistor; a first electrode of the driving transistor is coupled to the first voltage terminal, and a second electrode of the driving transistor is coupled to the light-emitting control sub-circuit and the data writing and compensation sub-circuit.

In an embodiment, the initialization sub-circuit comprises a first transistor and a second transistor; a gate of the first transistor is coupled to the first signal terminal, a first electrode of the first transistor is coupled to the first voltage terminal, and a second electrode of the first transistor is coupled to the first terminal of the storage capacitor; a gate of the second transistor is coupled to the first signal terminal, a first electrode of the second transistor is coupled to the initial voltage terminal, and a second electrode of the second transistor is coupled to the second terminal of the storage capacitor.

In an embodiment, the data writing and compensation sub-circuit comprises a third transistor and a fourth transistor; a gate of the third transistor is coupled to the scan signal terminal, a first electrode of the third transistor is coupled to the data voltage terminal, and a second electrode of the third transistor is coupled to the first terminal of the storage capacitor; a gate of the fourth transistor is coupled to the scan signal terminal, a first electrode of the fourth transistor is coupled to the second electrode of the driving transistor, and a second electrode of the fourth transistor is coupled to the second terminal of the storage capacitor.

In an embodiment, the light-emitting control sub-circuit comprises a fifth transistor, a sixth transistor and a seventh transistor; a gate of the fifth transistor is coupled to the enable signal terminal, a first electrode of the fifth transistor is coupled to the second voltage terminal, and a second electrode of the fifth transistor is coupled to the first terminal of the storage capacitor; a gate of the sixth transistor is coupled to the enable signal terminal, a first electrode of the sixth transistor is coupled to the second electrode of the driving transistor, and a second electrode of the sixth transistor is coupled to the light-emitting sub-circuit; a gate of the seventh transistor is coupled to the second signal terminal, a first electrode of the seventh transistor is coupled to the third voltage terminal, and a second electrode of the seventh transistor is coupled to the light-emitting sub-circuit.

In an embodiment, the light-emitting sub-circuit comprises a light-emitting device; an anode of the light-emitting device is coupled to the second electrode of the sixth transistor, and a cathode of the light-emitting device is coupled to the second electrode of the seventh transistor.

An embodiment of the present disclosure provides a display device, comprising the OLED pixel circuit described above.

An embodiment of the present disclosure provides a driving method of an OLED pixel circuit, comprising: during an initialization period of one frame, initializing, by an initialization sub-circuit, a driving sub-circuit under control of a first signal terminal, a first voltage terminal and an initial voltage terminal; during a data writing and compensation period of one frame, performing, by a data writing and compensation sub-circuit, threshold voltage compensation for the driving sub-circuit through a signal inputted at a data voltage terminal under control of a scan signal terminal; and during a light-emitting period of each frame from a first frame to an N-th frame, controlling, by a light-emitting control sub-circuit, a light-emitting sub-circuit to be turned off under control of an enable signal terminal, a second voltage terminal, a second signal terminal and a third voltage terminal; during a light-emitting period of each frame after the N-th frame, controlling, by the light-emitting control sub-circuit, the light-emitting sub-circuit to be turned on under control of the enable signal terminal, the second voltage terminal, the second signal terminal and the third voltage terminal; where N is an integer and $1 \leq N \leq 5$.

In an embodiment, N is equal to two.

In an embodiment, the initialization sub-circuit comprises a first transistor and a second transistor; during an initialization period of one frame, an initialization signal is inputted at the first signal terminal to control the first transistor and the second transistor to be turned on, thereby initializing the driving sub-circuit.

In an embodiment, the data writing and compensation sub-circuit comprises a third transistor and a fourth transistor; during a data writing and compensation period of one frame, a scan signal is inputted at the scan signal terminal to control the third transistor and the fourth transistor to be turned on, thereby compensating for the threshold voltage of the driving sub-circuit.

In an embodiment, the light-emitting control sub-circuit comprises a fifth transistor, a sixth transistor and a seventh transistor; during a light-emitting period of each frame from a first frame to an N-th frame, an enable signal is inputted at the enable signal terminal to control the fifth transistor and the sixth transistor to be turned on, and a first signal is inputted at the second signal terminal to control the seventh transistor to be turned off, thereby controlling the light-emitting sub-circuit to be turned off; during a light-emitting period of each frame after the N-th frame, an enable signal is inputted at the enable signal terminal to control the fifth transistor and the sixth transistor to be turned on, and a second signal is inputted at the second signal terminal to control the seventh transistor to be turned on, thereby controlling the light-emitting sub-circuit to be turned on.

Embodiments of the present disclosure provide an OLED pixel circuit and a driving method thereof, and a display device, the light-emitting control sub-circuit is adopted to control turn-on or turn-off of the light-emitting sub-circuit. Specifically, when displaying is just getting started, the circuit in the OLED pixel circuit is unstable, the light-emitting control sub-circuit controls the light-emitting sub-circuit to be turned off, and after a few frames, when the circuit in the OLED is stable, the light-emitting control sub-circuit controls the light-emitting sub-circuit to be turned on. In this way, when the light-emitting sub-circuit is turned on, the circuit in the OLED pixel circuit is already relatively stable, in this case, the plurality of driving transistors in the OLED pixel circuit have a relatively uniform degree of being turned on, so that the currents flowing through the driving transistors to the light-emitting device are relatively uniform in terms of magnitude, which can remarkably avoid a splash screen phenomenon from occurring to the display panel.

BRIEF DESCRIPTION OF THE DRAWINGS

In order to more clearly explain the technical solutions in the embodiments of the present disclosure or in the prior art, drawings necessary for describing the embodiments of the present disclosure or the prior art will be briefly introduced below, obviously, the following described drawings are merely some embodiments of the present disclosure, for those of ordinary skill in the art, it is possible to obtain other drawings based on these drawings without paying creative efforts.

DETAILED DESCRIPTION OF THE EMBODIMENTS

Hereinafter, the technical solutions in the embodiments of the present disclosure will be described clearly and comprehensively in combination with the drawings in the embodiments of the present disclosure, obviously, these described embodiments are parts of the embodiments of the present disclosure, rather than all of the embodiments thereof. All the other embodiments obtained by those of ordinary skill in the art based on the embodiments of the present disclosure without paying creative efforts fall into the protection scope of the present disclosure.

Figure 1:
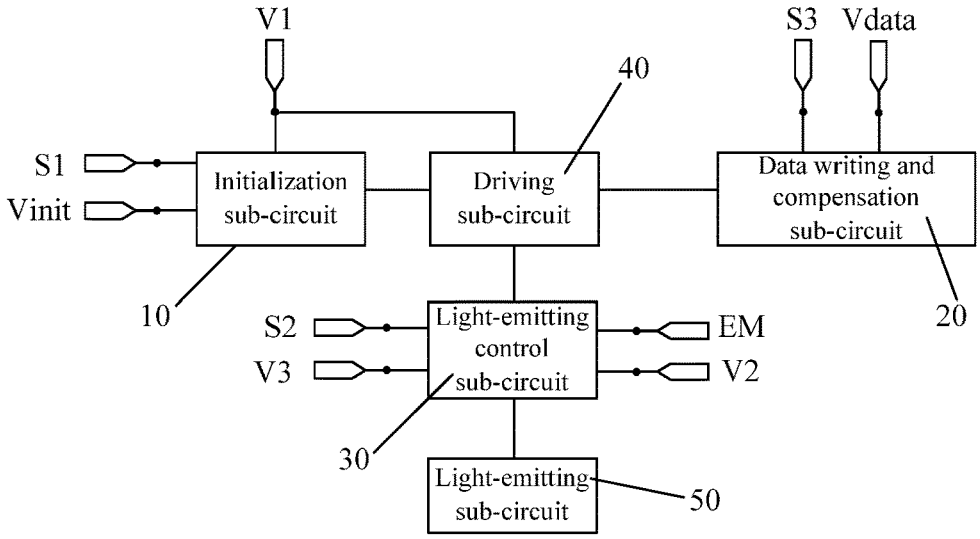
FIG. 1 is a schematic diagram of structure of an OLED pixel circuit according to an embodiment of the present disclosure.

An embodiment of the present disclosure provides an OLED pixel circuit, as shown in FIG. 1, the OLED pixel circuit comprises an initialization sub-circuit 10, a data writing and compensation sub-circuit 20, a light-emitting control sub-circuit 30, a driving sub-circuit 40 and a light-emitting sub-circuit 50.

Specifically, the initialization sub-circuit 10 is coupled to the driving sub-circuit 40, a first signal terminal S1, a first voltage terminal V1 and an initial voltage terminal Vinit, respectively, and configured to initialize the driving sub-circuit 40 under control of the first signal terminal S1, the initial voltage terminal Vinit and the first voltage terminal V1.

The data writing and compensation sub-circuit 20 is coupled to the driving sub-circuit 40, a scan signal terminal S3 and a data voltage terminal Vdata, respectively, and configured to perform threshold voltage compensation for the driving sub-circuit 40 through a signal inputted at the data voltage terminal Vdata under control of the scan signal terminal S3.

The driving sub-circuit 40 is further coupled to the light-emitting control sub-circuit 30 and the first voltage terminal V1, and configured to drive the light-emitting sub-circuit 50 to emit light under control of the first voltage terminal V1 and the light-emitting control sub-circuit 30 after threshold voltage compensation has been performed.

The light-emitting control sub-circuit 30 is further coupled to the light-emitting sub-circuit 50, an enable signal terminal EM, a second voltage terminal V2, a second signal terminal S2 and a third voltage terminal V3, and configured to enable the light-emitting sub-circuit 50 to be turned on or off under control of the enable signal terminal EM, the second voltage terminal V2, the second signal terminal S2 and the third voltage terminal V3.

An embodiment of the present disclosure provides an OLED pixel circuit, the light-emitting control sub-circuit 30 is adopted to control turn-on or turn-off of the light-emitting sub-circuit 50. Specifically, when displaying is just getting started, the circuit in the OLED pixel circuit is unstable, the light-emitting control sub-circuit 30 controls the light-emitting sub-circuit 50 to be turned off, and after a few frames, when the circuit in the OLED is stable, the light-emitting control sub-circuit 30 controls the light-emitting sub-circuit 50 to be turned on. In this way, when the light-emitting sub-circuit 50 is turned on, the circuit in the OLED pixel circuit is already relatively stable, in this case, the plurality of driving transistors in the OLED pixel circuit have a relatively uniform degree of being turned on, so that the currents flowing through the driving transistors to the light-emitting device are relatively uniform in terms of magnitude, which can remarkably avoid a splash screen phenomenon from occurring to the display panel.

Figure 2:
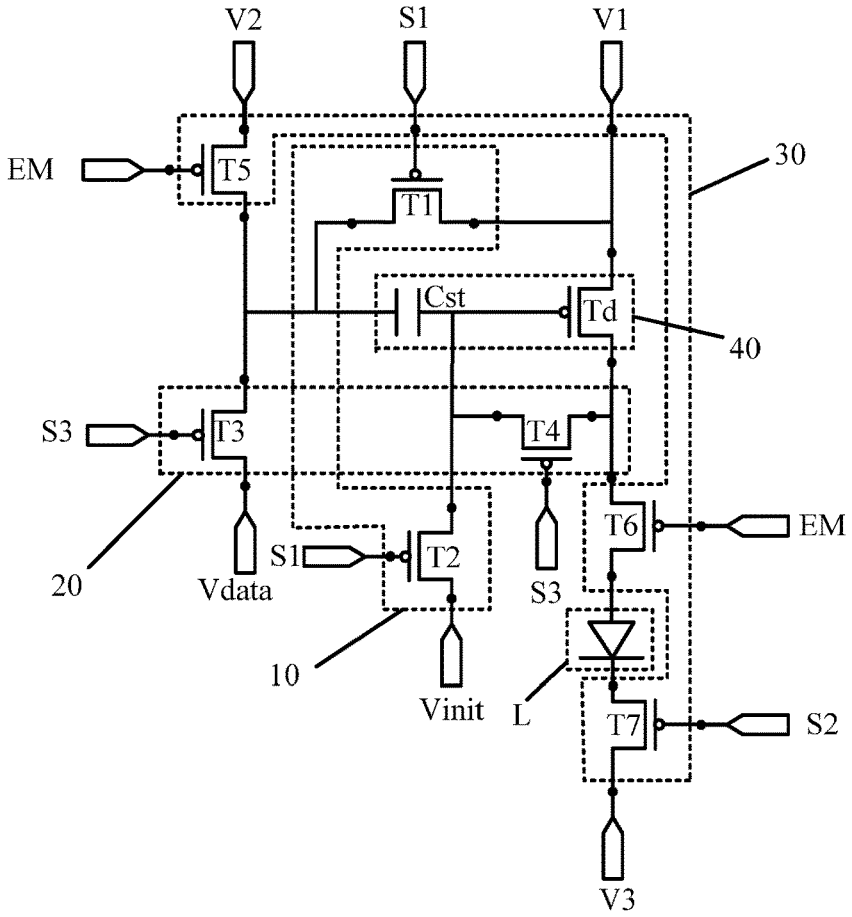
FIG. 2 is a schematic diagram of concrete structure of each sub-circuit of the OLED pixel circuit shown in FIG. 1.

Further, specifically, as shown in FIG. 2, the driving sub-circuit 40 comprises a storage capacitor Cst and a driving transistor Td.

A first terminal of the storage capacitor Cst is coupled to the initialization sub-circuit 10, the data writing and compensation sub-circuit 20 and the light-emitting control sub-circuit 30, and a second terminal of the storage capacitor Cst is coupled to a gate of the driving transistor Td.

A first electrode of the driving transistor Td is coupled to the first voltage terminal V1, and a second electrode of the driving transistor Td is coupled to the light-emitting control sub-circuit 30 and the data writing and compensation sub-circuit 20.

It should be noted that, the driving sub-circuit 40 may further comprise a plurality of driving transistors Td connected in parallel. The above description is only an example of the driving sub-circuit 40, other structures that have the same functions as the driving sub-circuit 40 will not be described in detail here, but they all should belong to the protection scope of the present disclosure.

As shown in FIG. 2, the initialization sub-circuit 10 comprises a first transistor T1 and a second transistor T2.

A gate of the first transistor T1 is coupled to the first signal terminal S1, a first electrode of the first transistor T1 is coupled to the first voltage terminal V1, and a second electrode of the first transistor T1 is coupled to the first terminal of the storage capacitor Cst.

A gate of the second transistor T2 is coupled to the first signal terminal S1, a first electrode of the second transistor T2 is coupled to the initial voltage terminal Vinit, and a second electrode of the second transistor T2 is coupled to the second terminal of the storage capacitor Cst.

It should be noted that, the initialization sub-circuit 10 may further comprise a plurality of switching transistors connected in parallel with the first transistor T1, and/or a plurality of switching transistors connected in parallel with the second transistor T2. The above description is only an example of the initialization sub-circuit 10, other structures that have the same functions as the initialization sub-circuit 10 will not be described in detail here, but they all should belong to the protection scope of the present disclosure.

As shown in FIG. 2, the data writing and compensation sub-circuit 20 comprises a third transistor T3 and a fourth transistor T4.

A gate of the third transistor T3 is coupled to the scan signal terminal S3, a first electrode of the third transistor T3 is coupled to the data voltage terminal Vdata, and a second electrode of the third transistor T3 is coupled to the first terminal of the storage capacitor Cst.

A gate of the fourth transistor T4 is coupled to the scan signal terminal S3, a first electrode of the fourth transistor T4 is coupled to the second electrode of the driving transistor Td, and a second electrode of the fourth transistor T4 is coupled to the second terminal of the storage capacitor Cst.

It should be noted that, the data writing and compensation sub-circuit 20 may further comprise a plurality of switching transistors connected in parallel with the third transistor T3, and/or a plurality of switching transistors connected in parallel with the fourth transistor T4. The above description is only an example of the data writing and compensation sub-circuit 20, other structures that have the same functions as the data writing and compensation sub-circuit 20 will not be described in detail here, but they all should belong to the protection scope of the present disclosure.

As shown in FIG. 2, the light-emitting control sub-circuit 30 comprises a fifth transistor T5, a sixth transistor T6 and a seventh transistor T7.

A gate of the fifth transistor 15 is coupled to the enable signal terminal EM, a first electrode of the fifth transistor 15 is coupled to the second voltage terminal V2, and a second electrode of the fifth transistor T5 is coupled to the first terminal of the storage capacitor Cst.

A gate of the sixth transistor T6 is coupled to the enable signal terminal EM, a first electrode of the sixth transistor T6 is coupled to the second electrode of the driving transistor Td, and a second electrode of the sixth transistor T6 is coupled to the light-emitting sub-circuit 50.

A gate of the seventh transistor T7 is coupled to the second signal terminal S2, a first electrode of the seventh transistor T7 is coupled to the third voltage terminal V3, and a second electrode of the seventh transistor T7 is coupled to the light-emitting sub-circuit 50.

It should be noted that, the light-emitting control sub-circuit 30 may further comprise a plurality of switching transistors connected in parallel with the fifth transistor T5, and/or a plurality of switching transistors connected in parallel with the sixth transistor T6, and/or a plurality of switching transistors connected in parallel with the seventh transistor T7. The above description is only an example of the light-emitting control sub-circuit 30, other structures that have the same functions as the light-emitting control sub-circuit 30 will not be described in detail here, but they all should belong to the protection scope of the present disclosure.

As shown in FIG. 2, the light-emitting sub-circuit 50 comprises a light-emitting device L; an anode of the light-emitting device L is coupled to the second electrode of the sixth transistor T6, and a cathode of the light-emitting device L is coupled to the second electrode of the seventh transistor T7.

Based on the above description of the specific circuit of each sub-circuit, the specific driving process of the above OLED pixel driving circuit will be described in detail below with reference to FIG. 2 and FIG. 3.

It should be noted that, first, the embodiments of the present disclosure do not limit the types of transistors in each sub-circuit and unit, i.e., the driving transistor Td, the first transistor T1, the second transistor T2, the third transistor T3, the fourth transistor T4, the fifth transistor T5, the sixth transistor T6 and the seventh transistor T7 mentioned above may be N-type transistors or P-type transistors. The following embodiments of the present disclosure are described by taking the aforementioned transistors as P-type transistors as an example.

The first electrode of the above transistors may be a drain and the second electrode thereof may be a source; or, the first electrode thereof may be a source, and the second electrode thereof may be a drain. The embodiments of the present disclosure make no limitations thereto.

In addition, transistors in the pixel circuit described above may be classified into enhanced transistors and depletion transistors depending on their conducting manners. The embodiments of the present disclosure make no limitations thereto.

Second, the embodiments of the present disclosure all are provided with that the first voltage terminal V1 is inputted with a high voltage level, the third voltage terminal V3 is inputted with a low voltage level, or the third voltage terminal V3 is grounded as an example, and the "high" and "low" here only indicate a relative magnitude relationship between the inputted voltages.

Figure 3:
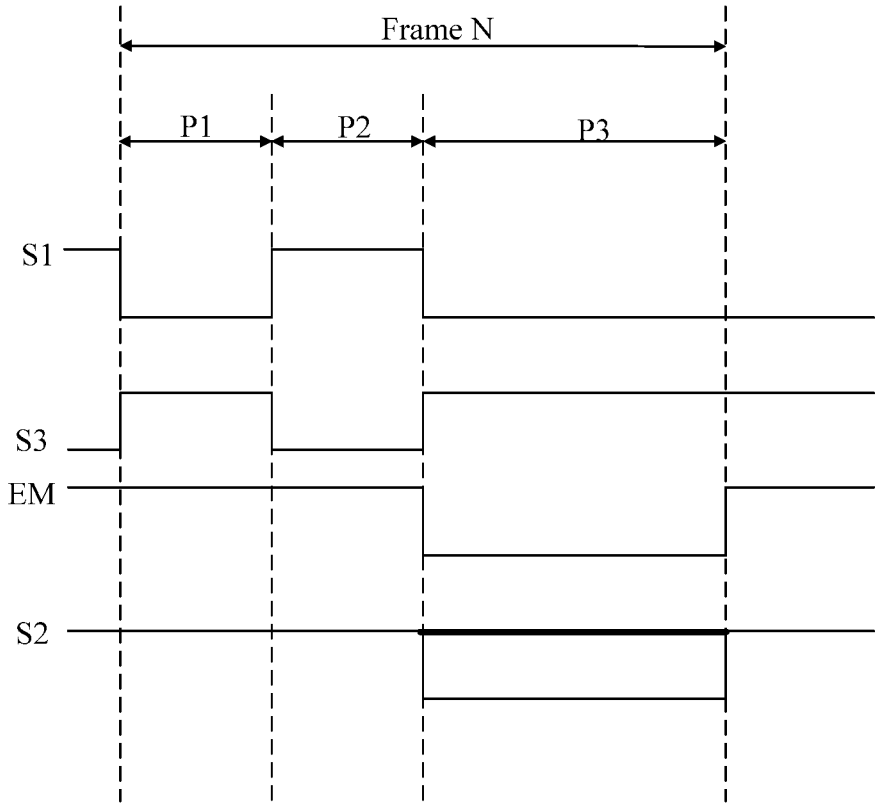
FIG. 3 is a timing diagram of various signals adopted for driving the OLED pixel circuit shown in FIG. 2.

As shown in FIG. 3, the display process of each frame of the OLED pixel circuit can be divided into an initialization period P1, a data writing and compensation period P2 and a light-emitting period P3. Among voltage values of the second signal terminal S2 during the light-emitting period P3 in FIG. 3, the thick solid line represents a waveform of the second signal terminal S2 of each frame in the 1-N frames, and the thin solid line represents a waveform of the second signal terminal S2 of each frame subsequent to an N-th frame, details are as follows.

Figure 4:
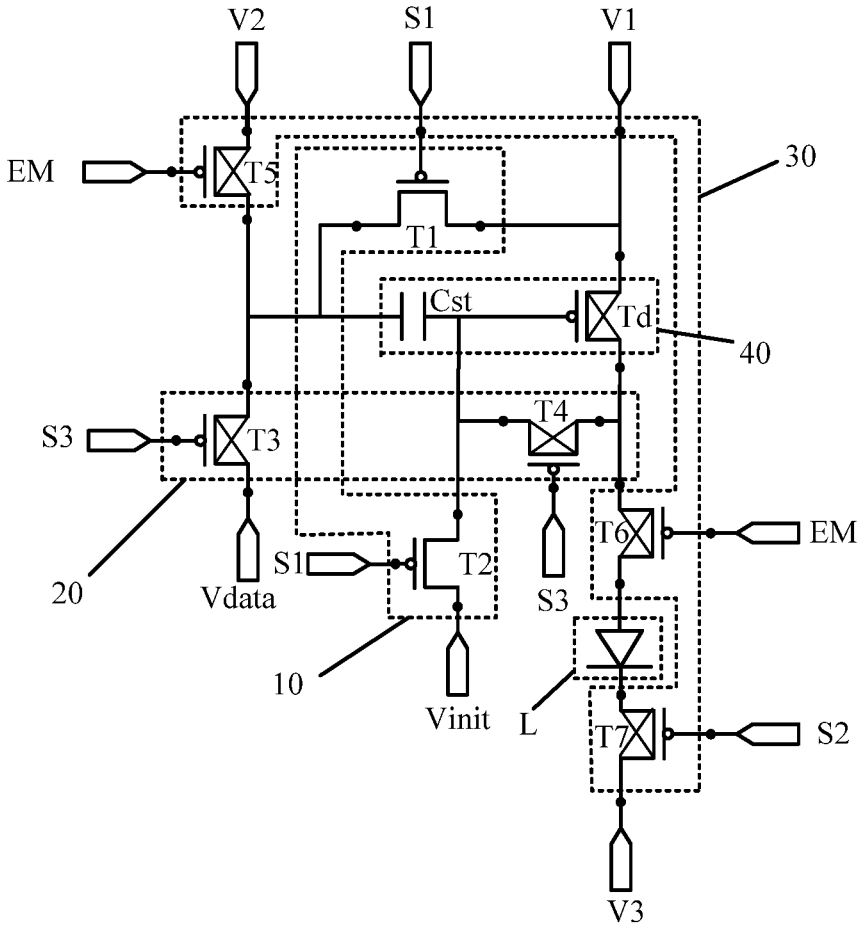
FIGS. 4 to 7 each are an equivalent circuit diagram of the OLED pixel circuit shown in FIG. 2 when corresponding to different situations.

During a reset period P1, the first signal terminal S1 is inputted with a low level turn-on signal, the second signal terminal S2, the enable signal terminal EM and the scan signal terminal S3 are inputted with a high level turn-off signal, based on this, an equivalent circuit diagram of the OLED pixel circuit shown in FIG. 2 is as shown in FIG. 4, the first transistor T1 and the second transistor T2 are turned on, the third transistor T3, the fourth transistor T4, the fifth transistor T5, the sixth transistor T6, the seventh transistor T7 and the driving transistor Td all are turned off (transistors in a turned-off state are marked with "X").

Herein, the first transistor T1 is turned on, the voltage at the initial voltage terminal Vini is written to the second terminal of the storage capacitor Cst; the second transistor T2 is turned on, the voltage at the first voltage terminal V1 is written to the first terminal of the storage capacitor Cst, thus initializing the voltage across two terminals of the storage capacitor Cst. Herein, the voltage at the initial voltage terminal Vini should be higher than the turn-on voltage of the driving transistor Id, after the voltage at the initial voltage terminal Vini is written to the second terminal of the storage capacitor Cst, the driving transistor Id should maintain a turned-off state.

Figure 5:
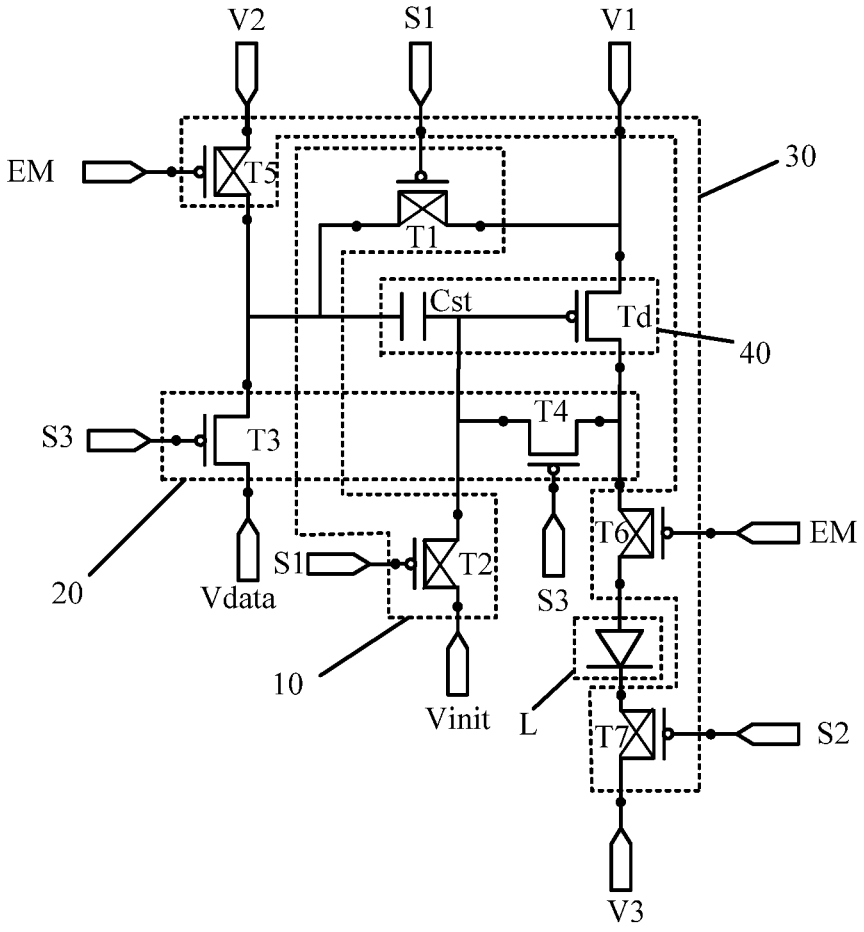

During the data writing period P2, the scan signal terminal S3 is inputted with a low level turn-on signal, the first signal terminal S1, the second signal terminal S2 and the enable signal terminal EM are inputted with a high level turn-off signal, based on this, an equivalent circuit diagram of the OLED pixel circuit shown in FIG. 2 is as shown in FIG. 5, the third transistor T3, the fourth transistor T4 and the driving transistor Td are all turned on, the first transistor T1, the second transistor T2, the fifth transistor T5, the sixth transistor T6 and the seventh transistor T7 are all turned off.

The third transistor T3 is turned on, the voltage at the data voltage terminal Vdata is written to the first terminal of the storage capacitor Cst, and the voltage at the first terminal of the storage capacitor Cst changes from V1 to Vdata, and a change amount is $\Delta V1=V1-Vdata$, based on this, the voltage at the second terminal of the storage capacitor Cst changes to $Vini--\Delta V1$, at this time, the voltage at the second terminal of the storage capacitor Cst controls the driving transistor Td to be turned on. When the driving transistor Td and the fourth transistor T4 are both turned on, the voltage at the first voltage terminal V1 is written to the second terminal of the storage capacitor Cst through the driving transistor Td and the fourth transistor T4, because there is a threshold voltage Vth in the driving transistor Td, in this case, the voltage at the second terminal of the storage capacitor Cst becomes V1+Vth, and the voltage at the second terminal of the storage capacitor Cst rises above the turn-on voltage of the control driving transistor Id, thus controlling the driving transistor Td to be turned off.

Figure 6:
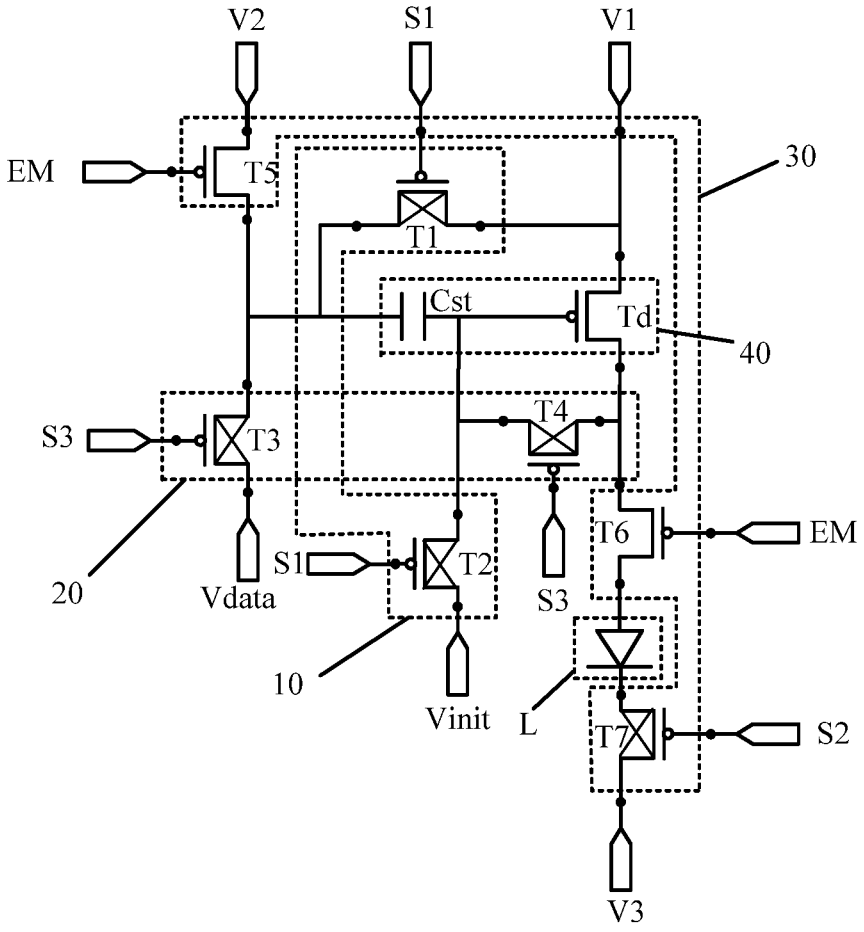

During the light-emitting period P3, the light-emitting period from the first frame to the N-th frame (N is a positive integer greater than or equal to one), the enable signal terminal EM is inputted with a low level turn-on signal, the first signal terminal S1, the second signal terminal S2 and the scan signal terminal S3 are inputted with a high-level turn-off signal, based on this, an equivalent circuit diagram of the OLED pixel circuit shown in FIG. 2 is as shown in FIG. 6, the fifth transistor 15, the sixth transistor T6 and the driving transistor Td are all turned on, the transistor T1, the second transistor T2, the third transistor 13, the fourth transistor T4 and the seventh transistor T7 are all turned off.

Herein, the fifth transistor 15 is turned on, the voltage at the second voltage terminal V2 is written to the first terminal of the storage capacitor Cst, and the voltage at the first terminal of the storage capacitor Cst changes from Vdata to V2, and a change amount is $\Delta V2=Vdata-V2$, based on this, the voltage at the second terminal of the storage capacitor Cst becomes $V1+Vth-\Delta V2=V1+Vth-Vdata+V2$, at this time, the voltage at the second terminal of the storage capacitor Cst decreases, thereby controlling the driving transistor Td to be turned on. When the driving transistor Td and the sixth transistor T6 are both turned on, the voltage at the first voltage terminal V1 is written to the anode of the light-emitting device L through the driving transistor Td and the sixth transistor T6. However, since the seventh transistor T7 is turned off, the voltage at the third voltage terminal V3 cannot be written to the cathode of the light-emitting device L, and the light-emitting device L remains turned-off at this time.

Figure 7:
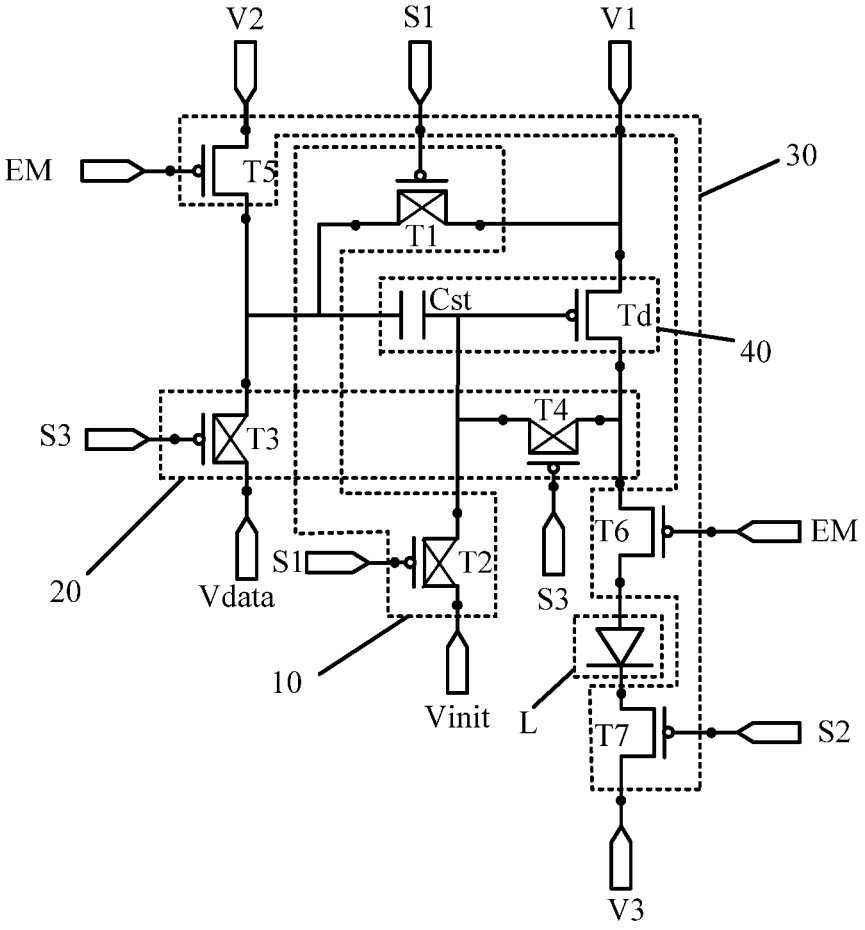

During a light-emitting period of each frame after the (N+1)-th frame, the enable signal terminal EM and the second signal terminal S2 are inputted with a low level turn-on signal, the first signal terminal S1 and the scan signal terminal S3 are inputted with a high level turn-off signal, based on this, an equivalent circuit diagram of the OLED pixel circuit shown in FIG. 2 is as shown in FIG. 7, the fifth transistor 15, the sixth transistor T6, the seventh transistor T7 and the driving transistor Td are all turned on, the first transistor T1, the second transistor T2, the third transistor T3 and the fourth transistor T4 are all turned off.

Herein, the fifth transistor T5 is turned on, the voltage at the second voltage terminal V2 is written to the first terminal of the storage capacitor Cst, the voltage at the first terminal of the storage capacitor Cst changes from Vdata to V2, and a change amount is $\Delta V2=Vdata-V2$, based on this, the voltage at the second terminal of the storage capacitor Cst becomes $V1+Vth-\Delta V2=V1+Vth-Vdata+V2$, at this time, the voltage at the second terminal of the storage capacitor Cst decreases, thereby controlling the driving transistor Td to be turned on. When the driving transistor Td and the sixth transistor T6 are both turned on, the voltage at the first voltage terminal V1 is written to the anode of the light-emitting device L through the driving transistor Td and the sixth transistor T6. The seventh transistor T7 is turned on, the voltage at the third voltage terminal V3 is written into the cathode of the light-emitting device L, in this case, the light-emitting device L is turned on to display images.

During a light-emitting period P3, after the driving transistor Td is turned on, in a case where the value obtained by subtracting the threshold voltage Vth of the driving transistor Td from a gate-source voltage Vgs of the driving transistor Td is less than or equal to the drain-source voltage Vds of the driving transistor Td, that is, Vgs−Vth≤Vds, the driving transistor Td can be in a saturated turned-on state, at this time, the driving current I flowing through the driving transistor Td is:

$$\begin{aligned} I_{oled} &= \frac{1}{2}K(V_{gs} - V_{th})^2 \\ &= \frac{1}{2}K[(V_1 + V_2 - V_{data} + V_{th}) - V_1 - V_{th}]^2 \\ &= \frac{1}{2}K(V_2 - V_{data})^2 \circ \end{aligned}$$

where K=W/L×C×u, W/L is an aspect ratio of the driving transistor Td, C is capacitance of a channel insulating layer, and u is a channel carrier mobility.

The above parameters are only related to structure of the driving transistor Td, thus, the current flowing through the driving transistor Td is only related to the data voltage outputted from data voltage terminal Vdata for displaying implementation and the voltage outputted by the second voltage terminal V2, it is irrelevant to the threshold voltage Vth of the driving transistor Td, thereby eliminating the influence caused by the threshold voltage Vth of the driving transistor Td on light-emitting luminance of the light-emitting device L, and improving uniformity of luminance of the light-emitting device L.

An embodiment of the present disclosure further provides a display device comprising the OLED pixel circuit described above.

An embodiment of the present disclosure provides a display device comprising any of the pixel driving circuit described above. The display device may comprise a plurality of pixel cell arrays, each pixel cell including any of the pixel driving circuit described above. The display device provided by the embodiment of the present disclosure has the same beneficial effects as the pixel driving circuit provided by the foregoing embodiments of the present disclosure. Since the pixel driving circuit has been described in detail in the foregoing embodiments, details will not be repeated here.

Figure 8:
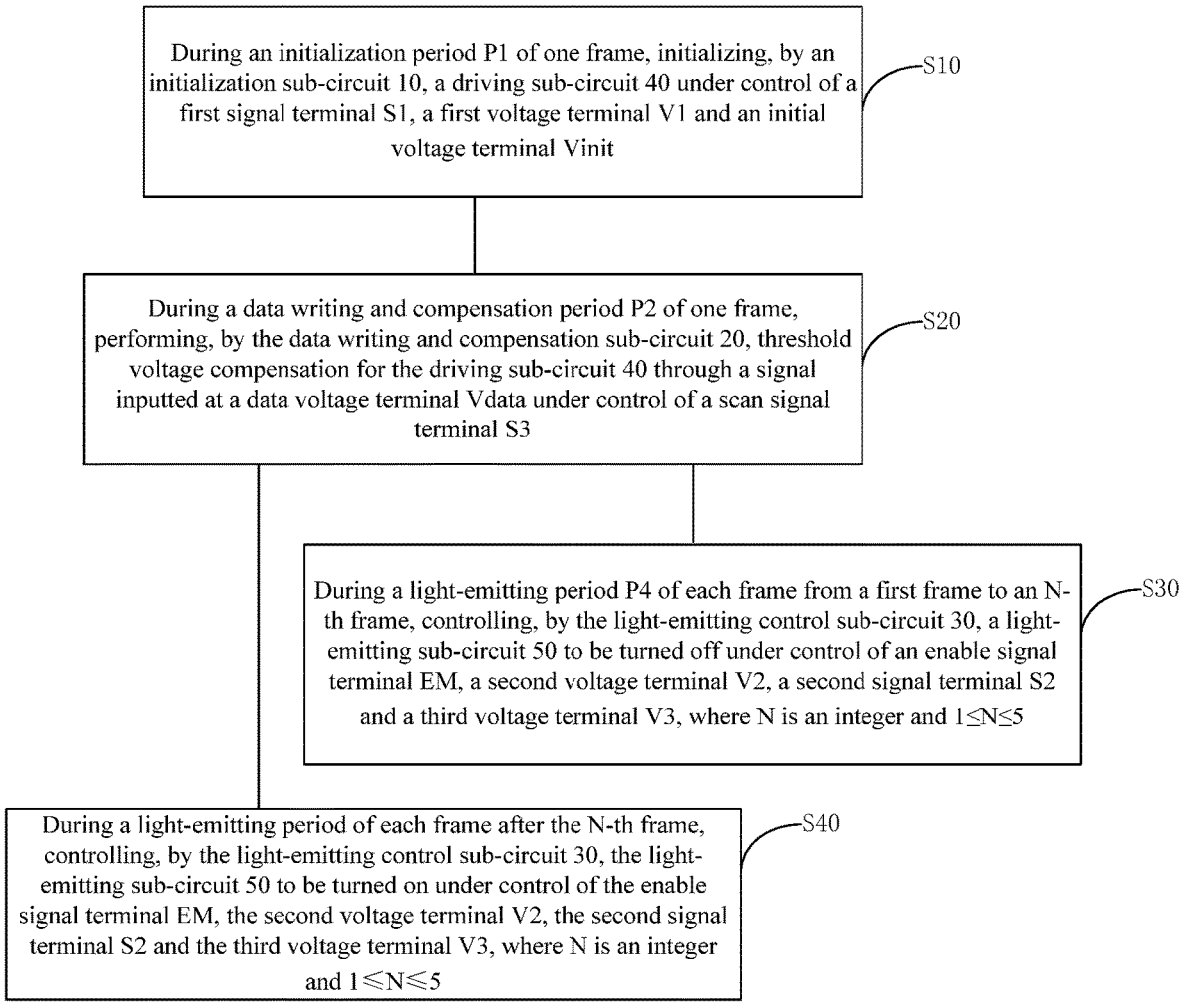
FIG. 8 is a schematic flowchart of an OLED pixel circuit driving method according to an embodiment of the present disclosure.

An embodiment of the present disclosure further provides a method for driving an OLED pixel circuit. As shown in FIG. 8, the driving method comprises:

S10, during an initialization period P1 of one frame, initializing, by an initialization sub-circuit 10, a driving sub-circuit 40 under control of a first signal terminal S1, a first voltage terminal V1 and an initial voltage terminal Vinit;

S20, during a data writing and compensation period P2 of one frame, performing, by a data writing and compensation sub-circuit 20, threshold voltage compensation for the driving sub-circuit 40 through a signal inputted at a data voltage terminal Vdata under control of a scan signal terminal S3;

S30, during a light-emitting period P4 of each frame from a first frame to an N-th frame, controlling, by the light-emitting control sub-circuit 30, a light-emitting sub-circuit 50 to be turned off under control of an enable signal terminal EM, a second voltage terminal V2, a second signal terminal S2 and a third voltage terminal V3; and S40, during a light-emitting period of each frame after the N-th frame, controlling, by the light-emitting control sub-circuit 30, the light-emitting sub-circuit 50 to be turned on under control of the enable signal terminal EM, the second voltage terminal V2, the second signal terminal S2 and the third voltage terminal V3;

where N is an integer and 1≤N≤5.

An embodiment of the present disclosure provides an OLED pixel circuit, the light-emitting control sub-circuit 30 is adopted to control turn-on or turn-off of the light-emitting sub-circuit 50. Specifically, when displaying is just getting started, the circuit in the OLED pixel circuit is unstable, the light-emitting control sub-circuit 30 controls the light-emitting sub-circuit 50 to be turned off, and after a few frames, when the circuit in the OLED is stable, the light-emitting control sub-circuit 30 controls the light-emitting sub-circuit 50 to be turned on. In this way, when the light-emitting sub-circuit 50 is turned on, the circuit in the OLED pixel circuit is already relatively stable, in this case, the plurality of driving transistors in the OLED pixel circuit have a relatively uniform degree of being turned on, so that the currents flowing through the driving transistors to the light-emitting device are relatively uniform in terms of magnitude, which can remarkably avoid a splash screen phenomenon from occurring to the display panel.

In consideration of that the circuit in the OLED pixel circuit is already relatively stable after two frames, therefore, in an embodiment of the present disclosure, N=2.

In an embodiment, the initialization sub-circuit 10 comprises a first transistor T1 and a second transistor T2.

During an initialization period P1 of one frame, an initialization signal is inputted at the first signal terminal S1 to control the first transistor T1 and the second transistor T2 to be turned on, thereby initializing the driving sub-circuit 40.

In an embodiment, the data writing and compensation sub-circuit 20 comprises a third transistor T3 and a fourth transistor T4.

During a data writing and compensation period P2 of one frame, a scan signal is inputted at the scan signal terminal S3 to control the third transistor T3 and the fourth transistor T4 to be turned on, thereby compensating for the threshold voltage of the driving sub-circuit 40.

In an embodiment, the light-emitting control sub-circuit 30 comprises a fifth transistor 15, a sixth transistor T6 and a seventh transistor T7.

During a light-emitting period P3 of each frame a first frame to an N-th frame, an enable signal is inputted at the enable signal terminal EM to control the fifth transistor 15 and the sixth transistor T6 to be turned on, and a first signal is inputted at the second signal terminal S2 to control the seventh transistor 17 to be turned off, thereby controlling the light-emitting sub-circuit 50 to be turned off.

During a light-emitting period P3 of each frame after the N-th frame, an enable signal is inputted at the enable signal terminal EM to control the fifth transistor T5 and the sixth transistor T6 to be turned on, and a second signal is inputted at the second signal terminal S2 to control the seventh transistor to be turned on, thereby controlling the light-emitting sub-circuit 50 to be turned on.

Embodiments of the present disclosure provide an OLED pixel circuit and a driving method thereof, and a display device, which can remove phenomenon such as a splash screen during power-on and a wake-up splash screen on the display pane.

Unless otherwise defined, technical terms or scientific terms used herein shall have common meaning known by those of ordinary skill in the art of the present disclosure. Words and expressions such as "first", "second" and the like used in the specification and claims of the present disclosure do not denote any sequence, quantity or priority, but distinguish different components. Likewise, words such as "include", "comprise" and the like refer to that an element or an object before this word contains all the elements or objects listed thereinafter or alternatives thereof, without excluding other elements or objects. Words such as "connected", "connecting" and the like are not restricted to physical or mechanical connections, but may include electrical connections, regardless of direct or indirect connections. Words such as "up", "below", "left", "right", etc., are only used to denote relative positional relationship, once an absolute position of the described object changes, the relative positional relationship may probably change correspondingly.

The above described merely are specific implementations of the present disclosure, but the protection scope of the present disclosure is not limited thereto, modification and replacements easily conceivable for those skilled in the art within the technical range revealed by the present disclosure all fall into the protection scope of the present disclosure. Therefore, the protection scope of the present disclosure is based on the protection scope of the claims.

What is claimed is:

1. An OLED pixel circuit, comprising: an initialization sub-circuit, a data writing and compensation sub-circuit, a light-emitting control sub-circuit, a driving sub-circuit, and a light-emitting sub-circuit;

the initialization sub-circuit is coupled to the driving sub-circuit, a first signal terminal, a first voltage terminal and an initial voltage terminal, respectively, and configured to initialize the driving sub-circuit under control of the first signal terminal, the initial voltage terminal and the first voltage terminal;

the data writing and compensation sub-circuit is coupled to the driving sub-circuit, a scan signal terminal and a data voltage terminal, respectively, and configured to perform threshold voltage compensation for the driving sub-circuit through a signal inputted at the data voltage terminal under control of the scan signal terminal;

the driving sub-circuit is further coupled to the light-emitting control sub-circuit and the first voltage terminal, and configured to drive the light-emitting sub-circuit to emit light under control of the first voltage terminal and the light-emitting control sub-circuit after threshold voltage compensation has been performed;

the light-emitting control sub-circuit is further coupled to the light-emitting sub-circuit, an enable signal terminal, a second voltage terminal, a second signal terminal and a third voltage terminal, and configured to enable the light-emitting sub-circuit to be turned on or off under control of the enable signal terminal, the second voltage terminal, the second signal terminal and the third voltage terminal, wherein the driving sub-circuit comprises a storage capacitor and a driving transistor;

wherein a first terminal of the storage capacitor is coupled to the initialization sub-circuit the data writing and compensation sub-circuit and the light-emitting control sub-circuit, and a second terminal of the storage capacitor is coupled to a gate of the driving transistor;

wherein a first electrode of the driving transistor is coupled to the first voltage terminal, and a second electrode of the driving transistor is coupled to the light-emitting control sub-circuit and the data writing and compensation sub-circuit, wherein the light-emitting control sub-circuit comprises a fifth transistor, a sixth transistor and a seventh transistor;

wherein a gate of the fifth transistor is coupled to the enable signal terminal, a first electrode of the fifth transistor is coupled to the second voltage terminal, and a second electrode of the fifth transistor is coupled, to the first terminal of the storage capacitor;

wherein a gate of the sixth transistor is coupled to the enable signal terminal, a first electrode of, the sixth transistor is coupled to the second electrode of the driving transistor, and a second electrode of the sixth transistor is coupled to the light-emitting sub-circuit;

wherein a gate of the seventh transistor is coupled to the second signal terminal, a first electrode of the seventh transistor is coupled to the third voltage terminal, and a second electrode of the seventh transistor is coupled to the light-emitting sub-circuit, and wherein during a light-emitting period of each frame from a first frame to an N-th frame, an enable signal is inputted at the enable signal terminal to control the fifth transistor and the sixth transistor to be turned on, a first signal is inputted at the second signal terminal to control the seventh transistor to be turned off and control the light-emitting sub-circuit to be turned off; during a light-emitting period of each frame after the N-th frame, an enable signal is inputted at the enable signal terminal to control the fifth transistor and the sixth transistor to be turned on, and a second signal is inputted at the second signal terminal to control the seventh transistor to be turned op and to control the light-emitting sub-circuit to be turned on.

2. The OLED pixel circuit according to claim 1, wherein during a light-emitting period of each frame from a first frame to an N-th frame, the light-emitting control sub-circuit is controlled to be turned off under control of the enable signal terminal, the second voltage terminal, and the second signal terminal and the third voltage terminal;

during a light-emitting period of each frame after the N-th frame, the light-emitting control sub-circuit is controlled to be turned on under control of the enable signal terminal, the second voltage terminal, the second signal terminal and the third voltage terminal;

where N is an integer and $1 \leq N \leq 5$.

3. The OLED pixel circuit according to claim 1, wherein the initialization sub-circuit comprises a first transistor and a second transistor;

a gate of the first transistor is coupled to the first signal terminal, a first electrode of the first transistor is coupled to the first voltage terminal, and a second electrode of the first transistor is coupled to the first terminal of the storage capacitor;

a gate of the second transistor is coupled to the first signal terminal, a first electrode of the second transistor is coupled to the initial voltage terminal, and a second electrode of the second transistor is coupled to the second terminal of the storage capacitor.

4. The OLED pixel circuit according to claim 1, wherein the data writing and compensation sub-circuit comprises a third transistor and a fourth transistor;

a gate of the third transistor is coupled to the scan signal terminal, a first electrode of the third transistor is coupled to the data voltage terminal, and a second electrode of the third transistor is coupled to the first terminal of the storage capacitor;

a gate of the fourth transistor is coupled to the scan signal terminal, a first electrode of the fourth transistor is coupled to the second electrode of the driving transistor, and a second electrode of the fourth transistor is coupled to the second terminal of the storage capacitor.

5. The OLED pixel circuit according to claim 1, wherein the light-emitting sub-circuit comprises a light-emitting device;

an anode of the light-emitting device is coupled to the second electrode of the sixth transistor, and a cathode of the light-emitting device is coupled to the second electrode of the seventh transistor.

6. The OLED pixel circuit according to claim 2, wherein N is equal to two.

7. A driving method of an OLED pixel circuit, comprising:

during an initialization period of one frame, initializing, by an initialization sub-circuit of the OLED pixel circuit, a driving sub-circuit under control of a first signal terminal, a first voltage terminal and an initial voltage terminal;

during a data writing and compensation period of one frame, performing, by a data writing and compensation sub-circuit of the OLED pixel circuit, threshold voltage compensation for the driving sub-circuit through a signal inputted at a data voltage terminal under control of a scan signal terminal; and during a light-emitting period of each frame from a first frame to an N-th frame, controlling, by a light-emitting control sub-circuit of the OLED pixel circuit, a light-emitting sub-circuit of the OLED pixel circuit to be turned off under control of an enable signal terminal, a second voltage terminal, a second signal terminal and a third voltage terminal; during a light-emitting period of each frame after the N-th frame, controlling, by the light-emitting control sub-circuit, the light-emitting sub-circuit to be turned on under control of the enable signal terminal, the second voltage terminal, the second signal terminal and the third voltage terminal;

where N is an integer and $1 \leq N \leq 5$, wherein the driving sub-circuit comprises a storage capacitor and a driving transistor;

a first terminal, of the storage capacitor is coupled to the initialization sub-circuit, the data writing and compensation sub-circuit and the light-emitting control sub-circuit, and a second terminal of the storage capacitor is coupled to a gate of the driving transistor;

a first electrode of the driving transistor is coupled to the first voltage terminal, and a second electrode of the driving transistor is coupled to the light-emitting control sub-circuit and the data writing and compensation sub-circuit, the light-emitting control sub-circuit comprises a fifth transistor, a sixth tranistor and a seventh transistor;

gate of the fifth transistor is coupled to the enable signal termingl, a first electrode of the fifth transistor is coupled to the second voltage terminal, and a second electrode of the fifth transistor is coupled to the first terminal of the storage capacitor;

a gate of the sixth transistor is coupled to the enable signal terminal, first electrode of the sixth transistor is coupled to the second electrode of the driving transistor, and a second electrode of the sixth transistor is coupled to the light-emitting sub-circuit;

a gate of the seventh transistor is coupled to the second signal terminal, a first electrode of the seventh transistor is coupled to the third voltage terminal, and a second electrode of the seventh transistor is coupled to the light-emitting sub-circuit, and during a light-emitting period of each frame from a first frame to an, N-th frame, an enable signal is inputted at the enable signal terminal to control the fifth transistor and the sixth transistor to be turned on, a first signal is inputted at the second signal terminal to control the seventh transistor to be turned off and control the light-emitting sub-circuit to be turned off; during a light-emitting period of each frame after the N-th frame, an enable signal is inputted at the enable signal terminal to control the fifth transistor and the sixth transistor to be turned on, and a second signal is inputted at the second signal terminal to control the seventh transistor to be turned on and to control the light-emitting sub-circuit to be turned on.

8. The driving method according to claim 7, wherein N is equal to two.

9. The driving method according to claim 7, wherein the initialization sub-circuit comprises a first transistor and a second transistor;

during an initialization period of one frame, an initialization signal is inputted at the first signal terminal to control the first transistor and the second transistor to be turned on, thereby initializing the driving sub-circuit.

10. The driving method according to claim 7, wherein the data writing and compensation sub-circuit comprises a third transistor and a fourth transistor;

during a data writing and compensation period of one frame, a scan signal is inputted at the scan signal terminal to control the third transistor and the fourth transistor to be turned on, thereby compensating for the threshold voltage of the driving sub-circuit.

11. A display device, comprising the OLED pixel circuit according to claim 1.

12. A display device, comprising the OLED pixel circuit according to claim 2.

13. A display device, comprising the OLED pixel circuit according to claim 3.

14. A display device, comprising the OLED pixel circuit according to claim 4.

* * * * *